US008763435B2

(12) United States Patent
McCaffrey et al.

(10) Patent No.: US 8,763,435 B2
(45) Date of Patent: Jul. 1, 2014

(54) LOCKING DEVICE

(75) Inventors: Martin McCaffrey, Eastbourne (GB); Pao-hsing Tseng, Hsin-Chuang (TW)

(73) Assignee: Camlock Systems Limited, Eastbourne, East Sussex (GB)

( * ) Notice: Subject to any disclaimer, the term of this patent is extended or adjusted under 35 U.S.C. 154(b) by 275 days.

(21) Appl. No.: 12/874,291

(22) Filed: Sep. 2, 2010

(65) Prior Publication Data

US 2011/0132050 A1 Jun. 9, 2011

(30) Foreign Application Priority Data

Sep. 2, 2009 (TW) ..... 98216195 U
Sep. 16, 2009 (GB) ..... 0916238.9

(51) Int. Cl.
*E05B 27/08* (2006.01)

(52) U.S. Cl.
USPC ..... 70/491; 70/392; 70/40; 70/419

(58) Field of Classification Search
USPC ..... 70/378, 392, 403, 404, 417, 419, 491, 70/496
See application file for complete search history.

(56) References Cited

U.S. PATENT DOCUMENTS

| | | | | | |
|---|---|---|---|---|---|
| 3,938,359 | A * | 2/1976 | Millett et al. | ..... | 70/491 |
| 4,012,931 | A * | 3/1977 | Harunari | ..... | 70/496 |
| 4,424,692 | A * | 1/1984 | Rousseau | ..... | 70/491 |
| 4,683,739 | A * | 8/1987 | Hughes | ..... | 70/365 |
| 4,794,772 | A * | 1/1989 | Falk et al. | ..... | 70/491 |
| 4,802,354 | A * | 2/1989 | Johnson | ..... | 70/491 |
| 4,831,852 | A * | 5/1989 | Hughes | ..... | 70/491 |
| 4,977,768 | A * | 12/1990 | Embry | ..... | 70/491 |
| 5,351,514 | A * | 10/1994 | Recio | ..... | 70/491 |
| 7,162,900 | B1 * | 1/2007 | Lu | ..... | 70/491 |
| 7,454,934 | B2 * | 11/2008 | Lin | ..... | 70/491 |
| 7,481,087 | B2 * | 1/2009 | De Vries | ..... | 70/491 |
| 7,574,882 | B2 | 8/2009 | Uliano | | |

* cited by examiner

*Primary Examiner* — Christopher Boswell
(74) *Attorney, Agent, or Firm* — Winstead PC

(57) ABSTRACT

The present invention relates to a locking device and to an actuating device for activating said locking device.

30 Claims, 12 Drawing Sheets

LOCKING DEVICE

The present invention relates to a locking mechanism, and a corresponding actuating device (e.g. a key) which is able to actuate the locking mechanism.

Traditional 'rotary pin tumbler' cylinder locks typically comprise three sections—an outer casing, a fixable inner tubular segment, and a rotatable core. The inner tubular segment typically comprises a number of equally spaced axial holes cut into the thickness of the wall of the inner segment which extend partially through the length of the inner segment. When functionally complete, the inner tubular segment is typically fixed to the outer casing, and each hole therein contains a spring which biases a driving rod away from the base of the hole. Typically the driving rods are of the same length. The rotatable core of the lock comprises a rod section which, when in situ, extends through the bore of the inner tubular segment, and further comprises a collar section radially extending from a proximal portion of the rod section, with holes extending axially through the length of the collar which are configured to align with the holes of the inner segment. Within these 'collar holes' are situated locking pins which are of different lengths.

The distal-facing surface of the core's collar section forms an interface plane with the proximal-facing surface of the inner tubular segment. The resulting line of separation between the driving rods and the locking pins is normally displaced from the interface plane, but is positioned by the proper key so that the line of separation of all of the locking pins align with the interface plane and permit rotation of the core.

There are a number of problems associated with traditional rotary pin tumbler locks, including the development of picking tools which can be used as a key to open such locks. Thus, it is an object of the present invention to provide a locking mechanism that addresses at least some of the problems associated with traditional rotary pin tumbler locks.

In this regard, the preset inventors have developed a locking mechanism comprising an outer housing member and an inner core, the inner core being rotatably movable within the outer housing member.

Thus, in one embodiment of the present invention there is disclosed a locking device comprising an outer housing member and an inner core, said inner core being receivable within said outer housing, said inner core comprising:

(a) at least one locking element comprising at least one projection; and (b) at least one receiving portion for receiving said at least one locking element;

wherein said at least one projection extends radially outwards from said inner core and said receiving portion;

said outer housing member comprising an internal face comprising:

(c) at least one axial channel; and (d) at least one annular channel;

each channel being able to receive said at least one projection of said at least one locking element.

Preferably the inner core of the locking device comprises a plurality of locking elements each situated in a receiving portion, said outer housing comprising a plurality of axial and annular channels, wherein said annular channels linking at least a number of said axial channels and being positioned at substantially the same distance along the axial length of the outer housing. Preferably each of the axial channels is linked by an annular channel such that in effect the annular channel extends completely around the inner wall of the outer housing.

In one aspect of the embodiment, the inner core additionally comprises a biasing means to urge said at least one locking element towards the proximal end of said inner core, such as a spring.

Preferably, at least one projection on said at least one locking element is axially displaced from said at least one annular channel of the outer housing when the device is in a resting configuration. Further, at least one projection on said at least one locking element may be axially aligned with the at least one annular channel of the outer housing when the device is in a configuration to allow rotation of the inner core.

In a preferred embodiment, the locking device comprises a plurality of locking elements wherein said projection on each of said plurality of locking elements is axially displaced when compared to another projection on another locking element when the device is in a resting configuration. Further, said projection on each of said plurality of locking elements is preferably axially aligned with each of the other projections on the other locking elements of the inner core and with the annular channel when the device is in a configuration to allow rotation of the inner core.

In a further embodiment of the present invention, the locking device has a number of the plurality of locking elements substantially equally spaced around the periphery of the inner core and at least one of the locking elements is offset from the substantially equal spacing of the remaining locking elements.

In one embodiment of the present invention, the outer housing further comprises at least one false notch extending annularly from at least one axial channel, wherein said false notch does not extend completely to a neighboring axial channel.

Preferably, the locking device has an inner core which further comprises at least one anti-drill element, such as a deflecting projection extending proximally from the inner core or a rotatable rod extending from the outer axial face of the inner core towards the axial center-point of the inner core.

In a further embodiment of the present invention there is provided a key for use with the lock. In some embodiments, the key may be a lock pick. The skilled person will understand that a lock pick may be as simple as, for example, a length of material (usually metal) which can be inserted into the mechanism of a lock and which is used to manipulate the various tumblers within the locking mechanism such that the mechanism reverts to a position where it can be unlocked. Such a 'simple' pick is not envisaged as part of the present invention. An alternative lock pick can exist as a tool, for example a unitary unit, which is able to mimic the key that is typically used for the lock in question. Such a tool may, for example, comprise adjustable pushing regions which correspond to the position of the locking elements of the inner core and which can be adjusted to configure the locking elements into a position where the inner core can be rotated, e.g. unlocked.

In one embodiment of the invention, the key has an actuating portion which is star shaped, having radially extending pushing regions.

In a further embodiment, the key may comprise an anti-drill deflector receiving portion.

In yet another embodiment of the invention, there is provided a lock and key combination, comprising the lock and a key.

There is also described the use of a lock and key of the invention, wherein a key is brought into contact with a locking device, wherein pressure is exerted on the at least one locking element of the inner core by the actuating portion of the key to urge the locking elements of the device towards the distal end of the inner core, wherein when the key reaches a predetermined position the projections of the locking elements are aligned with each other and with an annular groove in the outer housing, and wherein the key is then rotated, thereby rotating the inner core.

The invention can be exemplified in the following description by reference to the attached figures, when appropriate. In this regard:

Figure 1:
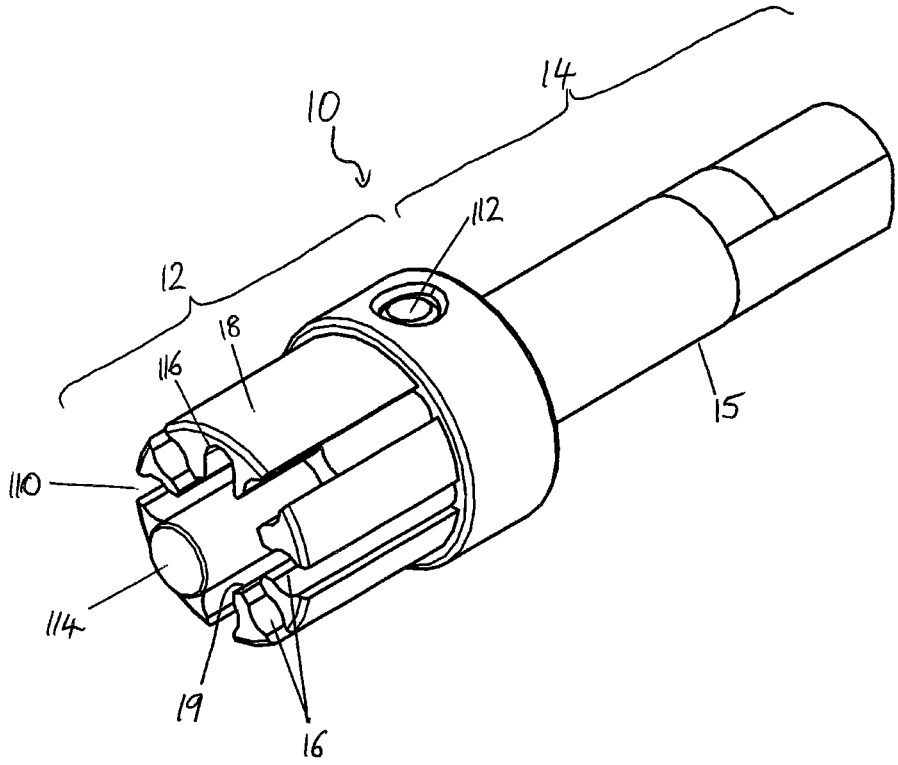
FIG. 1 shows an isometric view of the inner core of an embodiment of the device of the present invention.
Figure 2:
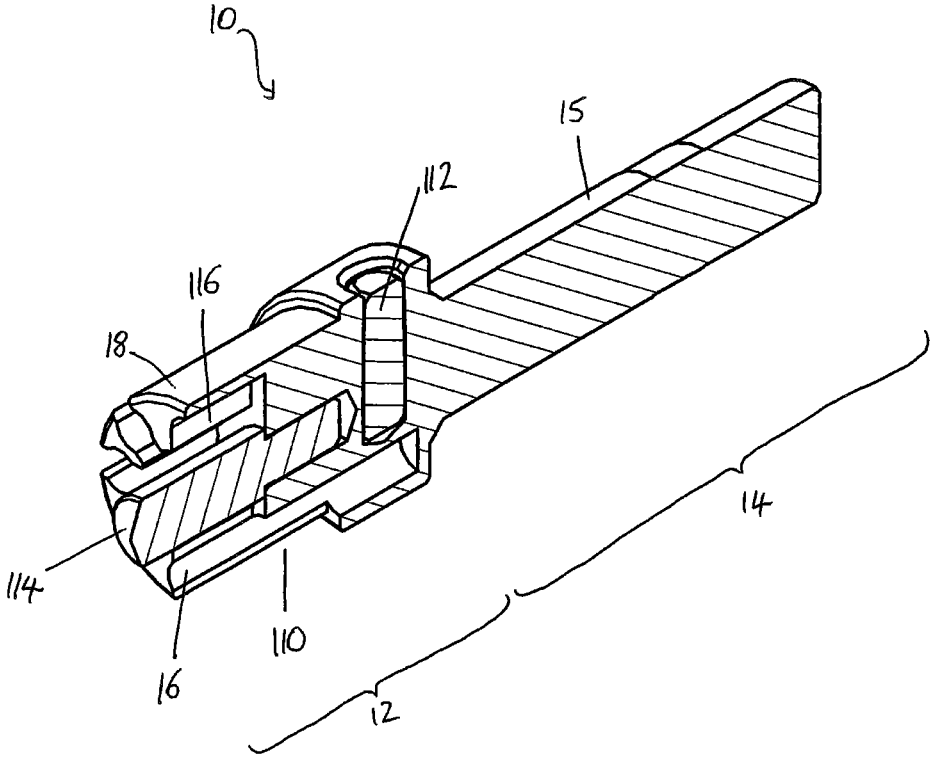
FIG. 2 shows an isometric cross-section of the view of the inner core as depicted in FIG. 1.
Figure 3:
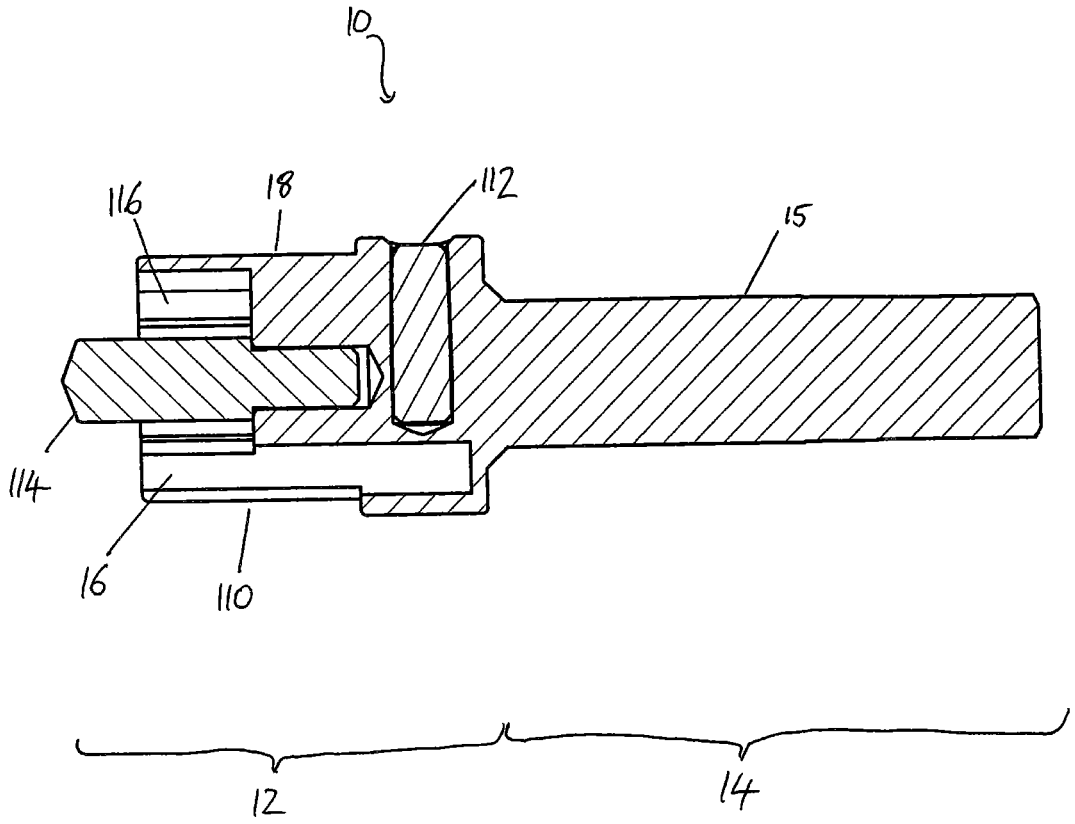
FIG. 3 shows a cross-section of the views of the inner core as depicted in FIGS. 1 and 2.

Discussing the inner core first, FIGS. 1-3 show that said inner core (10) comprises a proximal section (12) and a distal section (14). The proximal section comprises at least one portion for receiving a locking element (16), such as a channel, and preferably a plurality of receiving portions (channels), extending axially along a length of the proximal section (12). As used herein, the terms 'receiving portions', 'channels' and 'grooves' are used interchangeably. At least one channel is cut such that it breaches (110) at least the radially external face (18) of the proximal section (12). The channel (16) can be of any cross-section, but should be able to receive a locking element (see FIGS. 4A-4C) such that there is minimal non-axial movement of said locking element. Examples of appropriate cross-sections are e.g. circular, polygonal (e.g. hexagonal, octagonal, etc.), square, triangular etc., although a circular or substantially circular cross-section is preferred. When discussing the various cross-sections, it should be evident from the present description that breaches of the walls (radially external (18), or internal (19) if present) of the inner core (10) are included in the description of the cross-section as a whole. Thus, for example, when discussing a circular cross-section, it is meant that the cross-section of the channel would be circular or substantially circular if it is imagined that the breaches in the wall(s) were not present.

Figure 4A:
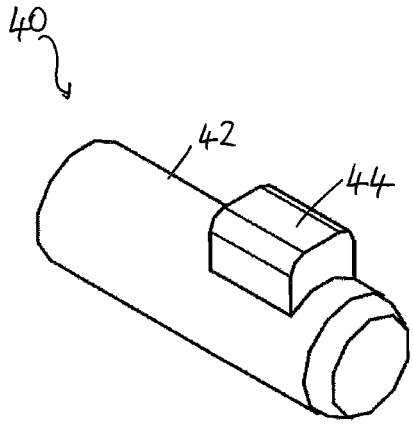
FIGS. 4A, 4B and 4C show various views of an embodiment of a locking element with projection of the present invention.
Figure 4B:
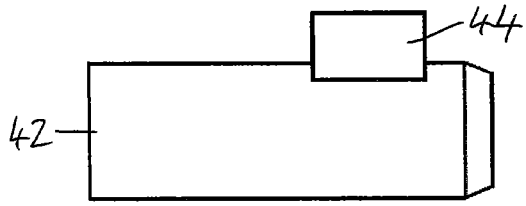
Figure 4C:
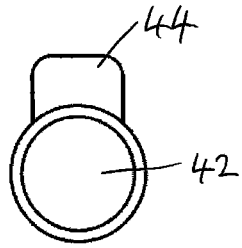

The proximal section (12) further comprises at least one locking element (40) as shown in FIGS. 4A-4C, which is to be situated in said at least one channel (16). The locking element (40) itself comprises at least two sections, a main body section (42) and at least one projection (44). The locking element main body section (42) has a cross-section that is designed to fit closely the main cross-section of said receiving channel (16), so that any movement apart from the axial movement of the locking element (40) along at least a portion of the length of the channel (16) is reduced. The projection (44) extends radially from the main body section (42) and is able to extend through the breach (110) in the external face of the proximal section of the inner core. The width of the projection (44) should be as close as possible to the width of the breach (110) of the channel in the external face of the proximal section, again to prevent excessive non-axial movement of the locking element within the channel.

Figure 12:
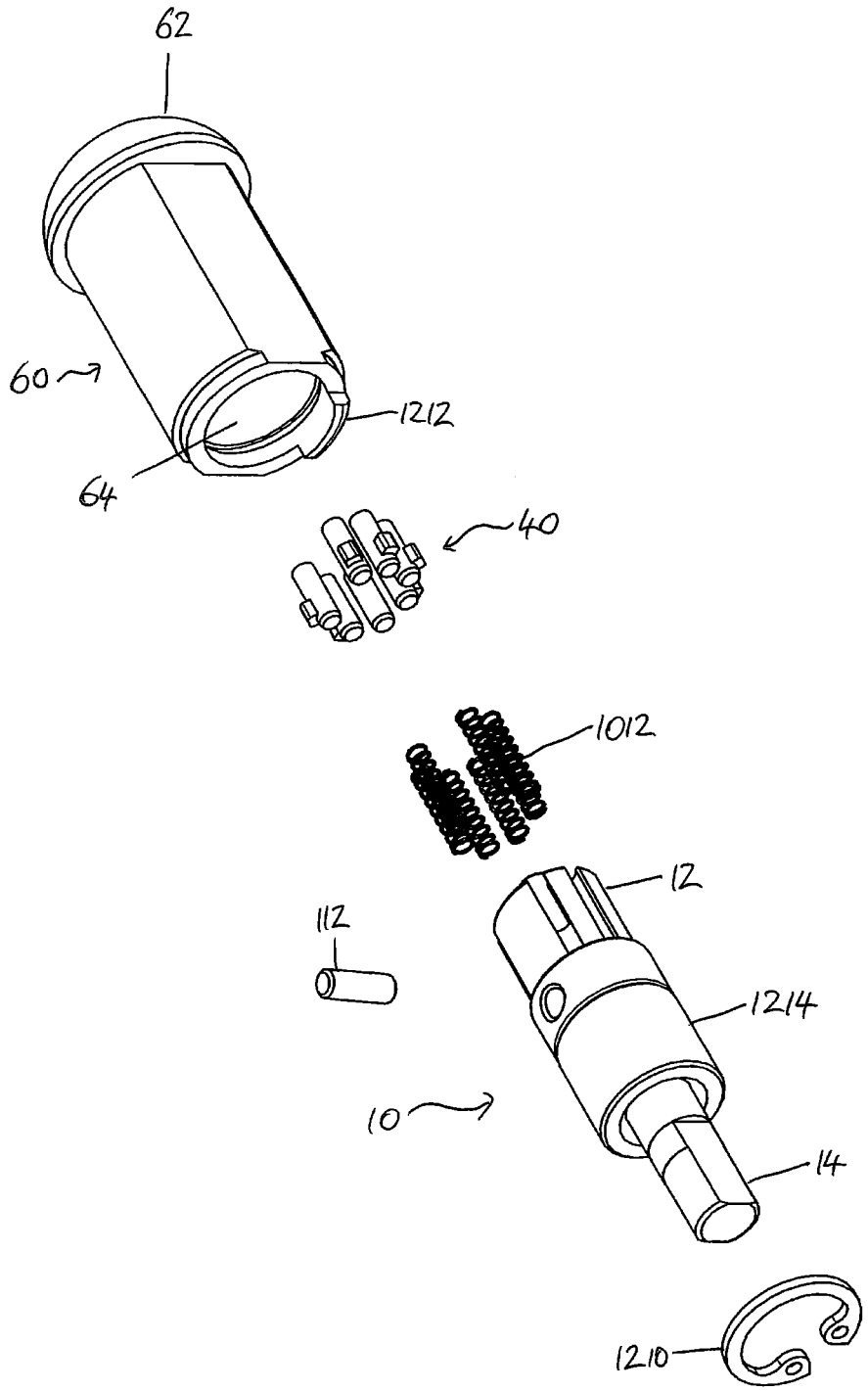
FIG. 12 is an isometric exploded view of an embodiment of the locking mechanism of the present invention.

The at least one locking element (40) is urged towards the proximal end of the proximal section (12) via resilient biasing means, such as a spring (FIG. 12, 1012). Said resilient biasing means can be situated anywhere where it is able to urge the locking element in the appropriate direction. Preferably, the biasing means is located in the distal part of the receiving channel (16), where it can be fixed to, or can be freely movable within, the channel. If the device comprises more than one locking element (40), then each biasing means (1012) (e.g. spring) urging each of the locking elements may be the same strength or different strengths.

The proximal section (12) of the inner core (10) can optionally further comprise at least one anti-drill mechanism (112, 114).

In one such embodiment, an anti-drill mechanism comprises a hole bored into the proximal section (12) extending from the radially outer surface (18) toward the axial center of the proximal section at approximately 90°, with a freely rotating anti-drill member (112) placed within the hole. The anti-drill member (112) is typically made from hardened steel, although any appropriate material can be used. The hole and corresponding anti-drill member typically extend to around the radially central point of the proximal section, although can terminate prior to that point or extend beyond it, even to the opposite face to the entry point in the proximal section in some embodiments. In this way, if an attempt is made to drill through the locking mechanism, the drill bit will contact the anti-drill member (112) which is able to spin freely, thus helping to prevent the drill bit from gaining any further purchase on the core of the locking mechanism.

The proximal section can optionally comprise a further anti-drill element (114) for helping to prevent drilling into the core. Such an anti-drill element may comprise, for example, a member extending in a proximal direction from the proximal section (12) which acts to deflect a drill bit. Such a member can be in any such configuration which acts to prevent a drill bit from gaining purchase on the locking device, and can comprise e.g. a conical member, or a spherical member (or section thereof), or any like member.

Figure 11A:
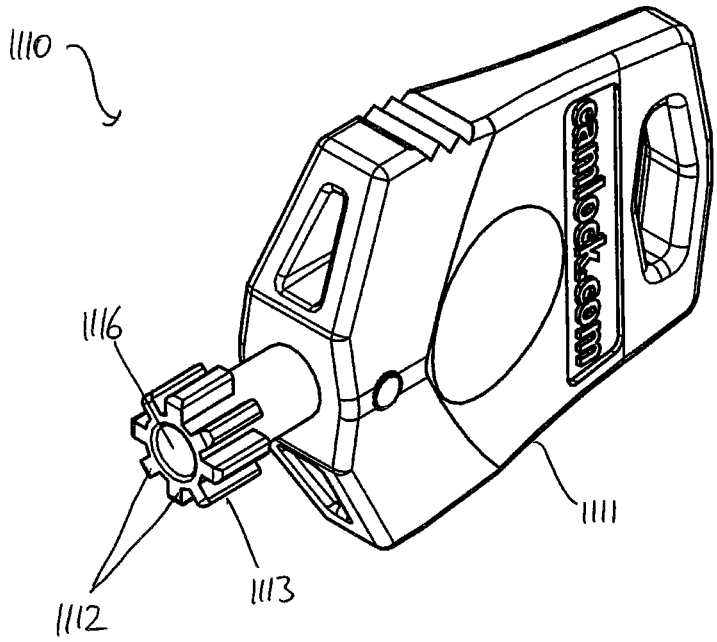
FIGS. 11A and 11B show views of one embodiment of a key of the present invention (pushing regions uncut)
Figure 11B:
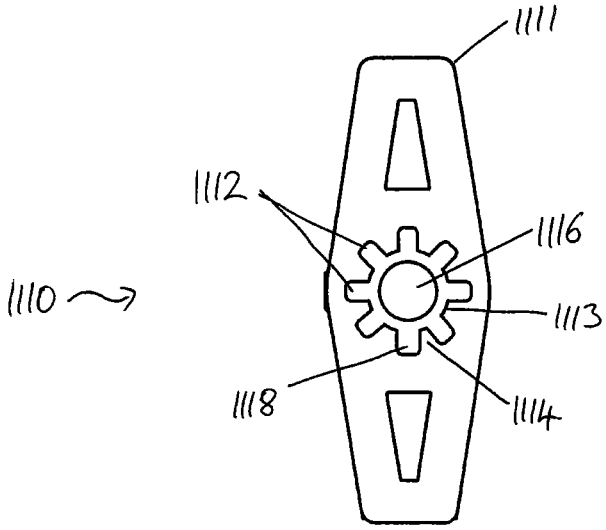

The proximal section of the inner core (12) may optionally comprise a guide channel (116), optionally without any locking element (40) and/or biasing means (1012) present within said channel. This channel is designed to receive a guide portion of a key (discussed below; FIG. 11B, 1118), so that alignment of said key with the locking element(s) is facilitated.

Figure 5:
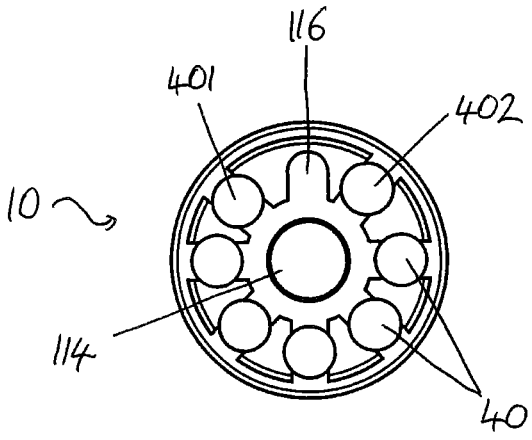
FIG. 5 shows an end view of the inner core of an embodiment of the present invention, looking at the proximal end.

The locking elements (44) (and, if present, the guide channel (116)) of the device may be equally spaced around the periphery of the inner core proximal section (12). Alternatively, and as exemplified in FIG. 5, the locking elements (40) may be spaced unequally. In a preferred embodiment, at least two locking elements (401, 402) are situated slightly offset from the equal spacing of the remaining locking elements (40). For example, the locking element (401, 402) either side of a reference point (e.g. a guide channel (116) (if present) or another locking element (40)) may be offset by about 0° to about 20°, preferably about 1° to about 15°, preferably about 5° to about 10°, and most preferably by about 5°. The skilled person will understand that any degree of offset to any of the locking elements and/or guide channel is intended to be encompassed by the present invention. The skilled person will further recognise that any offset to the locking elements may need to be matched by corresponding offset to the axial channels in the outer housing member, the key, and to the key receiving section of the proximal end of the outer housing (if appropriate; see FIG. 8, items 816 and 801, 802), as discussed below.

The cross-section of the proximal section (12) of the inner core can be any cross-section that allows the inner core to rotate within the outer housing member. Preferably, the cross-section is circular, or substantially circular.

The distal section (14) of the inner core extends distally from the proximal section (12), and can be associated with, among other features, e.g. a locking arm (not shown). The skilled person will be aware of any appropriate configuration that can be used for the distal section. Preferably, the distal section (14) comprises a rod (15), with the locking arm being integral with the rod, or being fixable to the rod. Preferably, the distal section (14) of the inner core is of a smaller diameter than that of the proximal section (12). The cross-section of the distal section can be any suitable cross-section, such as e.g. circular, polygonal (e.g. hexagonal, octagonal, etc.), square, triangular etc., although a circular or substantially circular cross-section is preferred. Preferably, the cross-section is a squared circular cross-section.

In another embodiment, the distal section (14) of the inner core can be configured depending on the application of the lock. For example, the distal section (14) may be associated with a switch, and thus the skilled person will understand that the cross-section and configuration of the distal section will be one which allows proper function of the switch. In alternative embodiments, there may be different shaped driving pieces associated with the distal section depending on the function of the lock.

The material of the inner core can be any suitable material, but will typically be a metal, such as brass or steel. Brass is preferred.

Figure 6:
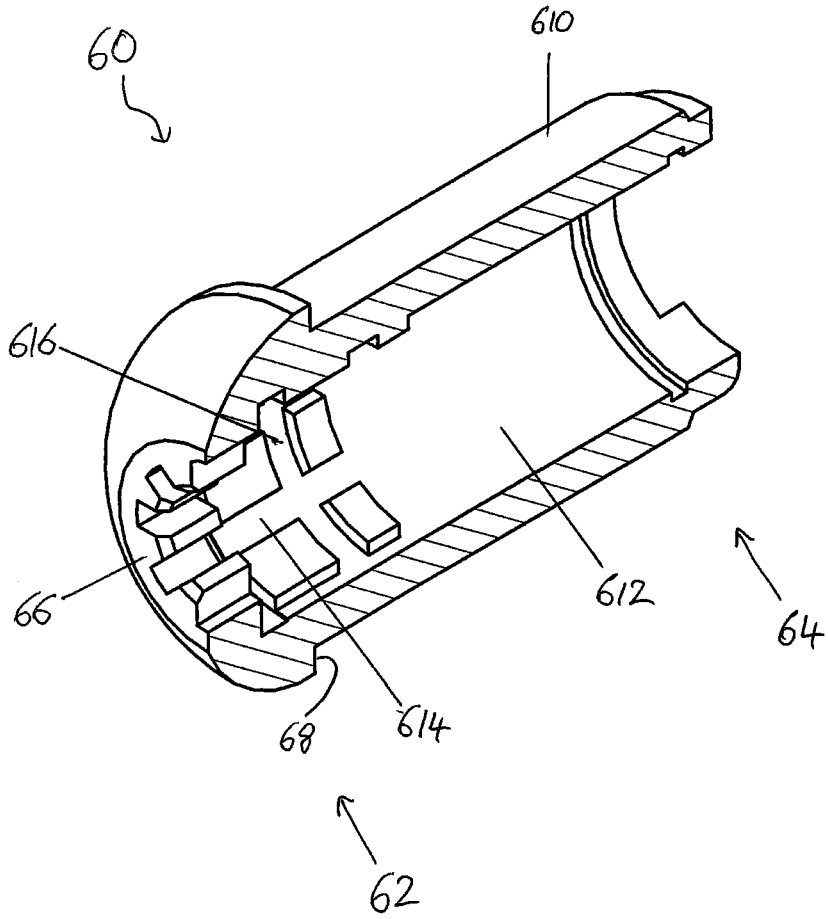
FIG. 6 shows an isometric cross-section of an embodiment of the outer housing of the present invention.
Figure 7:
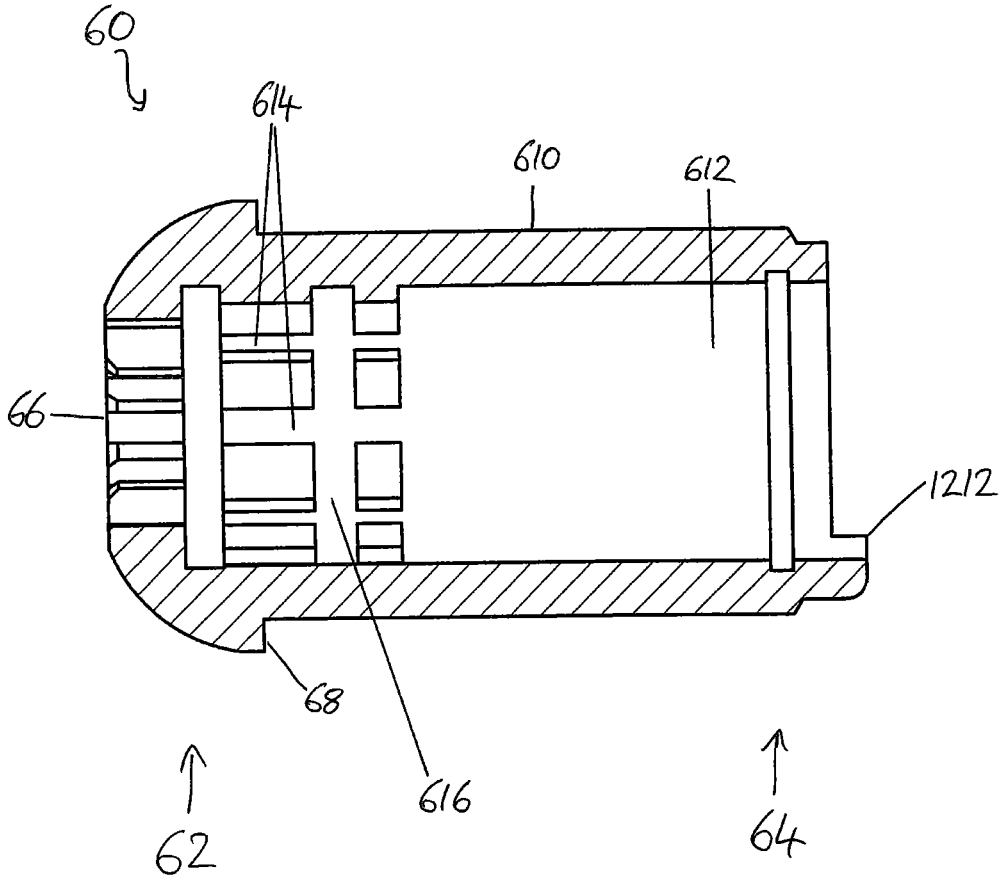
FIG. 7 shows a cross-section of the view of the outer housing as depicted in FIG. 6.

Turning now to the outer housing member (60), as shown in FIGS. 6 and 7 this may be a hollow cylinder-like structure comprising a proximal end (62) and a distal end (64).

The proximal end (62) of the outer housing member is typically the user interface and thus comprises a region (66) for accepting a key to operate the locking mechanism via rotation of the inner core. The proximal end (62) can be of any shape and cross-section depending on where the lock will be utilised. For example, the proximal portion can be mushroom-shaped, or can lie reasonably flush with the surface on which it is installed. There is preferably an overhang (68) present which can be used to abut the face of the item requiring locking.

Figure 8:
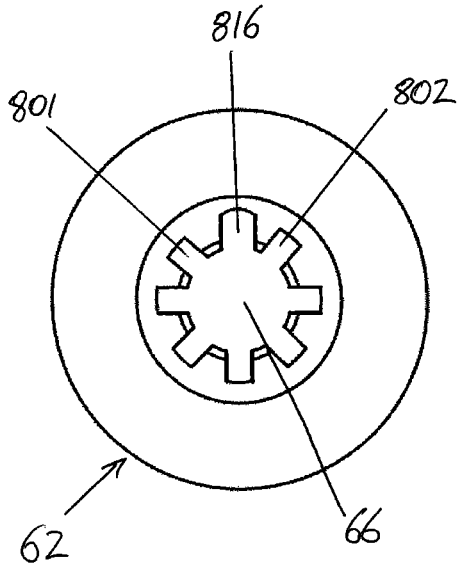
FIG. 8 shows an end view of the outer housing of an embodiment of the present invention, looking at the proximal end.

In one embodiment of the outer housing member (60), the proximal end (62, 66) is designed such that it is able to receive a 'star' shaped key, i.e. it has a 'star' shaped hole (66) in the proximal end, as exemplified in e.g. FIG. 8. In such an embodiment, it is possible to have a relatively small circular cross sectional area which may otherwise be used as a starting point to attempt to drill out the locking mechanism. Further, if the housing is made from hardened steel, the star arrangement may act as a further deterrent to would-be lock breakers.

Moving along the length of the outer housing member from the proximal (62) to the distal (64) end, the housing comprises external (610) and internal (612) walls. The external wall (610) can be of any construction, and is typically designed to fit into the item which requires the lock. The outer cross-section can be any appropriate cross-section, such as e.g. circular, polygonal (e.g. hexagonal, octagonal, etc.), square, triangular etc., although a circular or substantially circular cross-section is preferred. Typically, the cross-section of the external wall is a squared circle, as exemplified in FIG. 9. At least one portion of the external wall may be able to receive a fixing element (not shown). Said fixing element is typically a locking nut, and the portion able to receive said fixing element is typically a threaded portion. When the lock is in situ, the proximal portion of the outer housing (62, 66) is accessible to a key, whilst the distal portion (64) is shielded from the user by e.g. the face of the item in which the lock is situated. The lock is held in place by the fixing element being tightened toward the proximal end (62) of the housing and clamping the face of the item between the fixing element and the overhang (68) of the proximal end. Alternatively, the housing may comprise a clip-type mechanism, wherein the housing is fixed simply by pushing the clip(s) past an engagement surface, whereby the clip(s) have to be manipulated radially inward from the distal end in order to remove the lock. The skilled person will be aware of other suitable arrangements.

Figure 9:
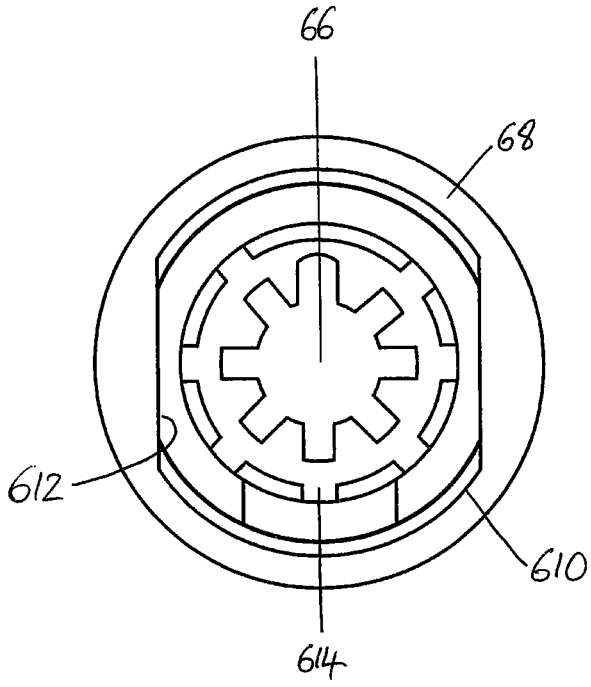
FIG. 9 shows an end view of the outer housing of an embodiment of the present invention, looking at the distal end.

As shown in FIGS. 6, 7 and 9, the internal wall (612) of the outer housing comprises at least one axial channel or groove (614). The projection (44) of the at least one locking element (40) is received by said channel (614), and in use the projection (44) is able to slide axially along (i.e. 'up and down') said channel. Generally, the width of said channel (614) should correspond reasonably closely to the width of said projection (44), so that any movement except for axial movement of the projection is kept to a minimum. In the present description, the 'channel' or 'groove' of the internal wall of the outer housing can refer to any arrangement whereby there is provided a region where the projection of the locking element (40) can run freely in a certain direction but where the projection is prevented from moving in another direction. The channel can, for example, be cut (e.g. machined) from a thicker portion of the wall of the outer housing, or can be formed by building up the thickness of the wall of the outer housing to create (a) channel(s) in the section(s) between the built-up areas.

At a predetermined distance along said axial channel (614), there is at least one annular channel or groove (616). When the projection (44) of the locking element (40) moves into alignment with said annular channel (616), there is no longer any barrier (e.g. from the walls of the axial channel (614)) preventing the projection (44) from moving annularly, and thus the projection can be moved away from the axial channel (614).

In one embodiment of the present invention, there is optionally provided at least one so-called 'false notch' (not shown) extending annularly from the axial channel (614). Said false notch does not extend to a distance sufficient to allow unlocking of the device. However, it may be advantageous to aid in confusing potential lock-pickers, since if the projection (44) on the locking element enters into the false notch, it may give the impression that the projection is in a position where unlocking can take place, when it is not.

Preferably, the outer housing is manufactured from a metal, such as hardened steel. The metal may e.g. be plated, e.g. chrome plated (e.g. for aesthetic purposes).

Figure 10:
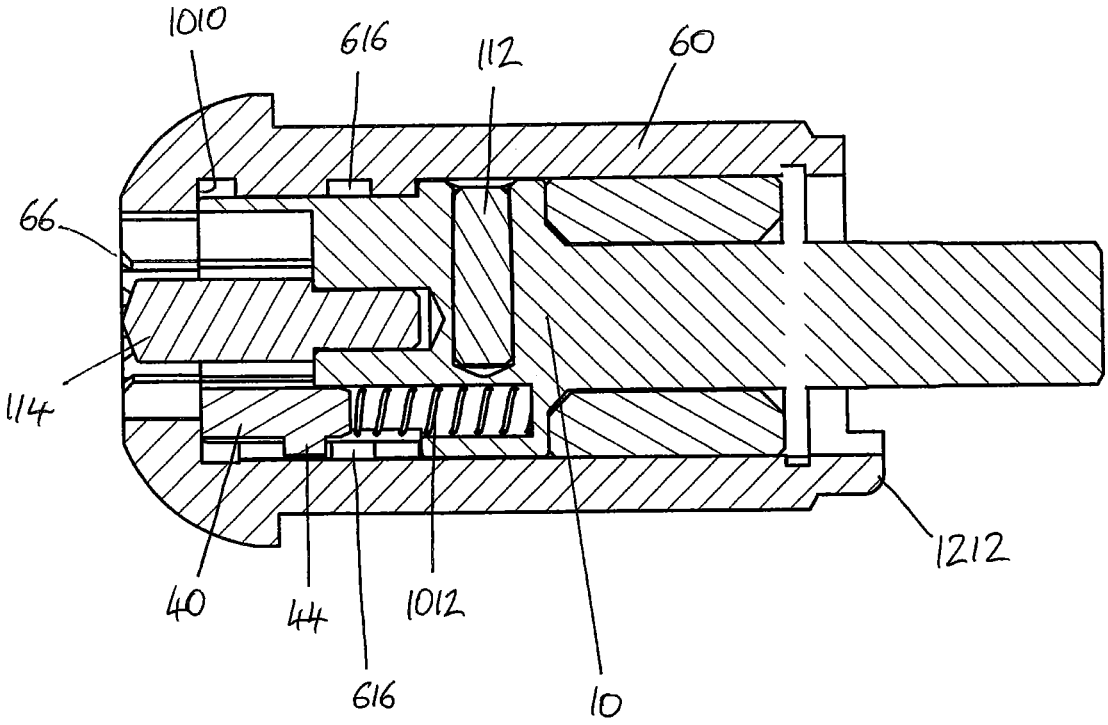
FIG. 10 shows a cross-section of an embodiment of the locking mechanism of the present invention, when the inner core is situated within the outer housing.

The at least one locking element (40) can be of any desired length. However, as depicted in FIG. 10, when the inner core (10) is properly situated within the outer housing member (60), there should be insufficient clearance between the proximal section of the inner core and the internal face (1010) of the proximal end of the outer housing to allow the locking element (40) to extend fully from its receiving channel (16)

and fall out. In one embodiment of the present invention, the size and shape of the key receiving region (66) will allow for the appropriate retention of the locking elements (40). Thus, in an embodiment of the invention where the key and key receiving region of the outer housing is a star shape, the portions ('fins') of the outer housing which extend between the apertures in the key receiving region (66) which receive the pushing regions of a key (thereby creating the 'star' effect) are such that the locking elements (40) abut their internal faces and are retained in position.

The locking device of the present invention can have any number of locking elements (40) depending on their size and the size of the proximal section (12) of the inner core (10). The more locking elements, the greater the number of possible combinations that will exist for the single successful unlocking combination of the lock. A typical lock of the present invention can have e.g. 3, 4, 5, 6, 7, 8, 9, 10, 11, 12, 13 etc. locking elements. Preferably, the lock of the present invention will have 5, 7 or 9 locking elements, preferably 7 locking elements. Each locking element can be manipulated independently of each other locking element.

As will be understood by a skilled person, each of the locking elements will have at least one projection, and thus the outer housing (60) must have at least a corresponding number of axial channels (614), each positioned so as to axially accommodate each projection (44). In a lock with multiple locking elements, the corresponding multiple axial channels in the outer housing will, at the same predetermined length along each of the channels, have an annular channel (616) extending therefrom. Preferably, each annular channel (616) will extend from one axial channel (614) to the neighboring axial channel, such that in effect there is formed an annular channel running around the inner wall (612) of the outer housing.

As mentioned previously, the locking elements can be of any desired length. In one embodiment of the present invention, the locking elements are substantially the same length.

In a 'resting' state, and as shown in FIG. 10, the at least one projection (44) on the at least one locking element (40) is urged away from the annular groove (616) by biasing means (1012) (e.g. a spring) and is prevented from non-axial movement by the walls of the axial channel. Thus, the inner core (10) is unable to be rotated. In this state, the locking device is typically in a 'locked' configuration.

In a preferred embodiment comprising a plurality of locking elements (40), the position of the projection(s) (44) on each of the locking elements (40) may be offset as compared to at least one other projection on another locking element. In this way, there is provided a range of unlocking combinations depending on the relative positions of each of the projections (44), with movement of the inner core (10) (i.e. locking and unlocking) of the device only possible when each of the projections (44) is in alignment with one another and with the annular channel (616). The skilled person will readily understand that if one of the projections (44) is not in alignment with the annular channel (616), then the walls of the axial channel (614) along which it runs will prevent that particular locking element (40) from non-axial movement, which in effect prevents the entire inner core (10) from rotating.

In use, when each of the projections (44) from each of the locking elements (40) is in alignment with the annular channel (616), there is no barrier (from e.g. the side-walls of the channels) to the annular movement of the projections, and the whole inner core (10) can then be rotated around its axis to effect locking or unlocking of the device.

As discussed supra, the biasing means (1012) associated with the inner core (10) bias the locking elements (40), and thus the projections (44), away from the annular channel (616) of the outer housing (60), such that in a 'resting' (e.g. locked) position, the projections (44) are positioned at different axial points along the inner core (10). In order to unlock the device, it is necessary to use a key (1110; see FIG. 11) to overcome the force of the biasing means (1012) and align all of the projections (44) with the annular channel (616). The key (1110) will typically have a gripping portion (1111) and an actuating portion (1113) and is configured such that it is able to push each of the locking elements (40) a predetermined length along the axial length of the inner core (10), such that when the key reaches a predetermined (e.g. fully inserted) position, all of the projections (44) are aligned with the annular channel (616). In other words, the key has a number of pushing regions (1112) corresponding to each of the locking elements (40), each of which is configured to push the corresponding locking element a predetermined distance, which predetermined distance is equivalent to the distance between the projection (44) of the locking element when in a 'resting' position and the annular channel (616). If the pushing regions (1112) of the key push the locking elements (40) too far, or not far enough, then the projections (44) on the locking elements will not align correctly with the annular channel (616) and rotation (e.g. unlocking) will be prevented.

In one embodiment, the invention comprises a 'star' shaped key (and, therefore, corresponding star shaped receiving hole in the outer housing). The present inventors have ascertained that such a 'star' configuration may be advantageous in that it may allow for a locking device with added security against unauthorised lock-picking over devices which are currently available. Such protection may be afforded, inter alia, by the regions ('fins') of the outer housing which separate each of the apertures which accommodate the pushing regions (1112) of a key, since, for example, although a pick may be able to push a locking element distally into the inner core, the fins of the outer housing will form a barrier to the pick further being able to rotate the inner core.

In a further embodiment of the present invention, at least one of the pushing regions (1112) of the key (and therefore the locking elements etc. as discussed above) is offset (1114) from the remaining pushing regions. When the key is a 'star' configuration, this may have a further advantage in that it could help to prevent removal of the key from the locking device when not in the 'resting' configuration. In other words, there is only one position where the key and the key receiving hole (66) of the proximal end of the housing member are aligned, which allows for easy insertion/removal of the key.

If the locking device has an anti-drill member (114) extending from the proximal section of the inner core (10), then the skilled person will recognise that the key may have a receiving portion (1116) which is able to accommodate said member in order that the key can fit into the locking mechanism to enable use.

The pushing regions (1112) of the key can be of any size, as long as they are able to push an individual locking element without pushing another. If the key has a guide portion (1118), this may be of a different size from the pushing portions (1112), for example larger. The guide portion may be any suitable element, such as a projection extending from the key. In one embodiment of the present invention, the key is a 'star' shaped key and in use the pushing regions (1112) are pushed beyond the separating regions (fins) of the key receiving region (66) of the outer housing such that there is no barrier to rotating the key whilst it resides within the outer housing.

It will be recognised that there are devices in the form of lock picks which may be used as a key to operate a locking mechanism. Such devices are intended to fall within the definition of a key as used in the present invention.

In this regard, the present invention provides a key in the form of an adjustable tool which can be adapted to fit a lock of the invention and thereafter unlock the mechanism. In one embodiment, the tool may comprise a body with a gripping portion and an actuating portion, the actuating portion comprising a number of pushing elements which are configurable to push each locking element (40) of the inner core (10) a predetermined distance such that the projections (44) on the locking elements (40) align with the annular groove (616) in the outer housing (60). In one embodiment, the pushing elements are movably attached and fixable to the tool body and can be independently moved and fixed of each other, such that each pushing element can be configured to an appropriate position in relation to the tool according to the respective locking element (40) which it is to push. Preferably, the tool comprises pushing elements that are able to push the locking elements (40) the appropriate distance and which also allow the subsequent rotation of the tool when the pushing elements are positioned within the outer housing (60), such that the inner core can be rotated without impedance from the regions (fins) of the outer housing separating the apertures of the key receiving portion (66). Preferably, the tool will comprise substantially L-shaped pushing regions, or any other suitable configuration.

In one embodiment, the 'uprights' of the pushing regions (which are movable and fixable to the body of the tool) may be closely spaced such that they can each be accommodated in the central region of the key receiving portion (66) of the outer housing (60), thereby avoiding being placed within one of the apertures forming an arm of the star. Such uprights may extend from the body of the tool, or may be incorporated in the body of the tool such that the body of the tool itself can be accommodated in the central region of the key receiving portion (66). In use, the pushing regions of the each of the pushing elements (i.e. the lower limb of the L) push against a locking element (40) the appropriate predetermined distance. In doing so, the lower limbs clear the fins of the star shaped region (66) of the outer housing. Since the uprights are substantially centrally placed and are also clear of the fins of the outer housing, the tool can then be rotated to activate the locking mechanism.

In one embodiment of constructing the complete locking device, the proximal end (12) of the inner core (10) is inserted into the distal end (64) of the outer housing (60). The inner core is positioned such that the projections (44) of the locking elements are aligned with their respective axial channels (614) in the outer housing, and the inner core is then pushed into the outer housing until the proximal end nears the proximal end of the outer housing. The inner core is held in position by a retaining means (see FIG. 12, 1210), which can be of any appropriate means known in the art. In the present embodiment, the retaining means (1210) may be an internal circlip which abuts the distal face of the proximal end of the inner core (said distal face being present in light of the distal end of the inner core having a smaller cross-section than the proximal end) and is biased outwards into a receiving groove on the internal wall at the distal end of the outer housing. However, there are many other alternatives that could be employed, such as various types of bolts, or even the crimping/folding of the distal end of the outer housing inwards in order to prevent axial movement of the inner core.

In one embodiment of the present invention, there may be incorporated on the distal end of the outer housing at least one projection (1212). On the distal section of the inner core, there may be fixed at least one element (not shown) which abuts the at least one projection (1212) on the outer housing, thereby allowing only partial rotation of the inner core (10). Such an element can be, for example, a pin or a cut washer with at least one protruding portion. If there is more than one projection and/or element, then it can be seen that the rotation of the inner core will only be allowed a certain number of degrees in either direction. Typically, when locked the element on the inner core will abut the projection (1212). Likewise, in a preferred embodiment there is another abutment when the device is fully unlocked, thus allowing the user easy operation of the locking device.

As described above, in a preferred embodiment there is also a locking arm (not shown) attached to the distal end (14) of the inner core. This can be fixed in any appropriate way, but is typically bolted on to the distal end of the inner core. Such a locking arm is received by a housing positioned within the item to be locked, or else can simply abut another region of the item to be locked, thus preventing relative movement between the region of the item containing the locking device and the region not containing the locking device.

Depending on the relative sizes of the proximal section (12) and distal section (14) of the inner core (10), there may also be present a spacing element (1214) which, in effect, extends the proximal section to allow the retaining means (1210) to rest securely against said proximal section.

In alternative, or additional, embodiments, the present invention relates to the structure of a multi-angle variable hidden lock. In particular, it relates to a key with asymmetrical teeth and a lock structure that corresponds to this key.

Typically, the key-receiving notches of a lock cylinder are symmetrically disposed and have gradually become an established standard. Thus, they are easily duplicated by thieves. Furthermore, thieves can also use electrical drills to destroy the lock core head and drill through the lock core, rendering the locking structure unable to lock. Therefore, its security effectiveness has been seriously compromised. The present inventor has designed a multi-angle variable hidden lock. It makes use of a design wherein the key has asymmetrical teeth and the keyhole and plugs are provided with asymmetrical notches. This design may increase the difficulty of manufacturing and deciphering the lock. It also makes use of strengthened lock core heads to decrease the probability of becoming damaged. It is therefore much more secure.

Thus, an object of the present creation is to provide a multi-angle variable hidden lock and key. Lock security during use is thus increased by means of the key's asymmetrical teeth and the asymmetrical keyhole and plugs.

Another object of the present creation is to provide a lock cylinder and lock core head for use in the lock. The lock cylinder and the lock core cannot be damaged easily because they have undergone strengthening treatment. They therefore increase the security of the lock during use.

In order to achieve the objects described above, the multi-angle variable hidden lock of the present creation comprises: a lock cylinder, one end of which is provided with a keyhole. The outer edge of the keyhole is circumferentially provided with a plurality of notches. These notches are disposed asymmetrically.

In addition, the inner wall of the lock cylinder may be provided with at least a first ring groove and a second ring groove. The outer edge of the other end of the lock cylinder is provided with at least a first retaining part. The lock core is provided inside the lock cylinder. The outer edge of one end of the lock core is provided with a plurality of plugs corresponding to the positions of the keyhole notches. In addition, it is centrally provided with a through-hole. Extended from the other end of the lock core is an axis rod. The axis rod is provided with a threaded part. A plurality of plugs and springs are provided in the plug slots of the lock core. In addition, the plugs are provided on one side with a positioning part, such that after the positioning parts are set in the plug slots, they project from the lock core surface. The lock core head is firmly set inside the through-hole in the center of the lock core. The snap ring is provided within the first ring groove of the lock cylinder, with the result that the above-described component parts installed within the lock cylinder are unable to fall out. The blocking plate is securely provided on the axis rod. The blocking plate is provided with a second axis hole. The outer edge of the blocking plate is provided with at least a second retaining part. When the locking core is rotated, the second retaining part and the first retaining part fasten to each other and thereby produce a movement-limiting effect. There is also a latch. One end of the latch is provided with a first axis hole whereby it is secured to the axis rod. The latch is in the shape of a long oval plate.

Furthermore, the present creation also provides a key that is used in the lock. The center of one end of the key is provided with a through-hole, and the outer edge is circumferentially provided with a plurality of teeth. The teeth correspond to the shape of keyhole, which is also asymmetrical. Thus, after inserting the key into the lock, the lock core head penetrates inside the keyhole, causing the teeth to drive the plugs, which cause the positioning parts of the plugs to sink into the second ring groove, thus driving the lock core and causing the latch and the blocking plate to rotate synchronously. The asymmetrical teeth design of the key and the asymmetrical keyhole and plug design are not easily replicated and can increase the number of combinations. They can thereby increase security during use.

In another embodiment, the lock cylinder is internally provided with a third ring groove near the keyhole to facilitate discharge of filings during broaching.

Furthermore, the lock cylinder and the lock core head may both be manufactured with medium-carbon steel and may optionally have undergone hardening heat treatment. They are thus not easily damaged and can increase security during use.

Thus, the lock of the present invention primarily comprises: a lock cylinder, a lock core, a plurality of plugs and springs, a lock core head, a snap ring, a blocking plate, a latch, and a key, where:

The lock cylinder has a hollow, tubular structure and is externally provided with a first threaded part, onto which a first nut can be screwed. The left end of the lock cylinder is provided with a ring edge, and the center is provided with a keyhole. The outer edge of the keyhole is provided with a plurality of notches. The notches of the keyhole are asymmetrically disposed. The set angles between adjacent notches differ.

For example, the angle between the first notch and the second notch may be 50 degrees, while the angle between the second notch and the third notch may be 40 degrees. And e.g. the angle between the third notch and the fourth notch may be 50 degrees.

In addition, on the inner wall of the lock cylinder, there is a first ring groove, a second ring groove and optionally a third ring groove. The first ring groove can be used to hold the snap ring. As for the second ring groove, after the plugs are pushed by the key, the plugs sink into the second ring groove, making it possible to rotate the lock core. The optional third ring groove is located near the keyhole and is used for discharging filing when the lock cylinder is broached.

On the outer edge at the right end of the lock cylinder, there is at least a first retaining part which catches the blocking plate and thereby limits the rotation. Furthermore, the lock cylinder may be made of medium carbon steel. In addition, the lock cylinder preferably has been heat treated to increase hardness.

The lock core moves within the lock cylinder, and the outer edge of the left end of the lock core is provided with a plurality of plugs that correspond to the keyhole notch positions, and it is centrally provided with a through-hole. Extending from the right end of the lock core is an axis rod, and the axis rod is provided with a second threaded part to receive a second nut. Furthermore, the plugs are partially or entirely exposed on the outer edge of the lock core. The outer edge of the lock core thus has a cut-open pattern.

The plugs and the springs are set in the plug slots of the lock core, and the plugs are provided on one side with a positioning part. The positioning parts of the plugs are provided at different heights so as to vary the permutations. Furthermore, after the plugs are set in their corresponding plug slots, the positioning parts project from the surface of the lock core.

The lock core head may be medium carbon steel. The lock core head moreover has preferably undergone hardening heat treatment. The lock core head is firmly set in the through-hole in the center of the lock core. In addition, the lock core head, in a cut-away view, can appear as a geometric shape, such as a circle or a polyhedron.

The snap ring is used to snap into the first ring groove of the lock cylinder to prevent the above-described component part installed in the lock cylinder from falling out. In addition, it can maintain the rotation of the lock core within the lock cylinder.

The blocking plate is secured to the axis rod and can rotate synchronously with the lock core. The blocking plate is provided with a second axis hole corresponding to the shape of the axis rod. The outer edge of the blocking plate is at least provided with a second retaining part. When the lock core is rotated, the second retaining part engages with the first retaining part and produces a position-limiting effect. For example, a space between the blocking plate and the lock cylinder limits motion to approx. 90 degrees. Therefore, the blocking plate can fix the rotation of the lock cylinder at approx. 90 degrees.

The latch may have a long, oval plate structure. At one end of the latch, there is a first axis hole. The first axis hole corresponds to the shape of the axis rod and thus can be secured onto the axis rod, with the result that the latch rotates synchronously with the lock core.

The center of one end of the key is provided with a through-hole, and the outer edge is circumferentially provided with a plurality of teeth. The teeth correspond to the shape of the keyhole and accordingly are asymmetrically arranged. In addition, the teeth have varying lengths that correspond to the plugs. Therefore, when the key is inserted into the keyhole, it can cause the lock core head to penetrate into the through-hole. The teeth equally push the plugs, causing the positioning parts of the plugs to attain the same height while also sinking into the second ring groove, thereby causing the lock core, the latch, and the blocking plate to rotate synchronously and thus to achieve the objective of locking or unlocking. In addition, the other end of the key is provided with a grip part to help the user to hold the key while turning it.

When the present creation is being installed, the lock cylinder is inserted into an installation hole. In addition, the ring edge and the first nut of the lock cylinder are separately provided on the planes of the two sides of the installation hole and complete the installation process by clamping the lock in position. During use, the key is inserted into the keyhole. When the key is turned, it immediately causes the teeth to push the plugs, the lock core, the blocking plate and the latch to turn synchronously. The locking objective is achieved by means of the latch catching the surface of e.g. an inner board of a cabinet. Then unlocking objective is achieved when the key is rotated in the other direction.

As discussed, the present creation may have the following strong points:

1. In the present creation, the keyhole of the lock cylinder and the teeth of the key both have an asymmetrical form, which can increase the variability of permutations and which is not easy to replicate. Thus, it can increase security during use.
2. Furthermore, in the present creation, the lock cylinder and the lock core head both may be made of medium carbon steel that has preferably undergone strengthening treatment and therefore cannot be easily damaged. This point also can increase security during use.

The above is only a preferred embodiment of the present creation and does not limit the scope of the present creation. Other shapes and sizes of the lock cylinder or sizes, shapes or materials of the lock core head or shapes or sizes of the key are also within the scope of this application. Therefore, all equivalent or easy modifications or embellishments made by a person skilled in the art that do not depart from the spirit and scope of the present creation shall be included within the scope of the present creation.

Thus, there is provided by the present invention a multi-angle, variable hidden lock, comprising:

a lock cylinder, one end of which is provided with a keyhole, the outer edge of the keyhole being circumferentially provided with a plurality of notches, the notches being disposed asymmetrically; the inner wall of the lock cylinder is also provided with at least a first ring groove and a second ring groove, the outer edge of the other end of the lock cylinder being provided with at least a first retaining part;

a lock core, which is provided inside the lock cylinder, the outer edge of one end of the lock core being provided with a plurality of plugs corresponding to the positions of the keyhole notches and being centrally provided with a through-hole; extending from the other end of the lock core is an axis rod, the axis rod being provided with a threaded part;

a plurality of plugs and springs, which are provided in the plug slots of the lock core, the plugs being provided on one side with a positioning part, such that after the positioning parts are set in the plug slots, they project from the lock core surface.

a lock core head, which is firmly set inside the through-hole in the center of the lock core;

a snap ring, which is provided within the first ring groove of the lock cylinder, with the result that the above-described component parts installed within the lock cylinder are unable to fall out;

a blocking plate, which is securely provided on the axis rod, the blocking plate being provided with a second axis hole, the outer edge of the blocking plate being provided with at least a second retaining part; when the locking core is rotated, the second retaining part and the first retaining part catch each other and thereby produce a movement-limiting effect.

a latch, one end of which is provided with a first axis hole whereby it is secured to the axis rod, the latch being in the shape of a long oval plate.

The multi-angle, variable hidden lock as described above may have provided a third ring groove within the lock cylinder near the keyhole.

The multi-angle, variable hidden lock as described above may have a lock cylinder made from medium carbon steel and which preferably has been hardened by heat treatment.

The multi-angle, variable hidden lock as described above may have a lock core head made from medium carbon steel and which preferably has been hardened by heat treatment.

A key is also described, which is applied to the multi-angle, variable hidden lock as described above, the center of one end which is provided with a through-hole, the outer edge being circumferentially provided with a plurality of teeth, the teeth corresponding to the shape of keyhole, which is also asymmetrical; thus, after inserting the key into the lock, the lock core head penetrates inside the keyhole, causing the teeth to drive the plugs, which cause the positioning parts of the plugs to sink into the second ring groove, thus driving the lock core and causing the latch and the blocking plate to rotate synchronously.

The invention claimed is:

1. A locking device comprising:

a plurality of locking elements, each locking element of the plurality of locking elements comprising a projection;

an outer housing member comprising a key-receiving region and an internal face, the key-receiving region comprising a central opening and a plurality of apertures extending radially from the central opening;

the internal face comprising:

a plurality of axial channels; and an annular channel;

each axial channel of the plurality of axial channels and the annular channel being able to receive a respective projection from the plurality of locking elements;

each axial channel of the plurality of axial channels being aligned with a corresponding aperture of the plurality of apertures of the key receiving region;

an inner core receivable within the outer housing member and comprising a receiving portion for each locking element of the plurality of locking elements; and wherein each projection extends radially outwards from the inner core.

2. The locking device of claim 1, wherein said annular channel links at least two axial channels of the plurality of axial channels.

3. The locking device of claim 1, wherein said inner core comprises a biasing means to urge the plurality of locking elements towards a proximal end of said inner core.

4. The locking device of claim 3, wherein the biasing means comprises a spring.

5. The locking device of claim 1, wherein said projection on each locking element of the plurality of locking elements is axially displaced from said annular channel of the outer housing member when the locking device is in a resting configuration.

6. The locking device of claim 1, wherein said projection on each locking element of the plurality of locking elements is axially aligned with the annular channel of the outer housing member when the locking device is in a configuration to allow rotation of the inner core.

7. The locking device of claim 1, wherein said projection on a first locking element of the plurality of locking elements is axially displaced relative to a projection on a second locking element of the plurality of locking elements of the locking device when the locking device is in a resting configuration.

8. The locking device of claim 1, wherein said projection of a first locking element of the plurality of locking elements is axially aligned with a projection of a second locking element of the plurality of locking elements and with the annular channel when the locking device is in a configuration to allow rotation of the inner core.

9. The locking device of claim 1, wherein the plurality of locking elements are substantially equally spaced around a periphery of the inner core.

10. The locking device of claim 1, wherein the plurality of locking elements are not all substantially equally spaced around a periphery of the inner core.

11. The locking device of claim 1, wherein the inner core comprises a guide channel to assist alignment of a key with said locking element.

12. The locking device of claim 1, wherein the outer housing member comprises a false notch extending annularly from at least one axial channel of the plurality of axial channels, wherein said false notch does not extend completely to a neighboring axial channel.

13. The locking device of claim 1, wherein said outer housing member comprises an outer-housing projection at a distal end.

14. The locking device of claim 13, wherein said inner core comprises an element abutting said outer-housing projection.

15. The locking device of claim 1, wherein said inner core comprises a locking arm.

16. The locking device of claim 1, wherein the outer housing member is made from steel.

17. The locking device of claim 1, wherein the inner core is a metal.

18. The locking device of claim 1, wherein the inner core comprises an anti-drill element.

19. The locking device of claim 18, wherein the anti-drill element comprises a deflecting projection extending proximally from the inner core.

20. The locking device of claim 18, wherein the anti-drill element comprises a rotatable rod extending from an outer radial face of the inner core towards an axial center-point of the inner core.

21. The locking device of claim 1, the locking device comprising a key, wherein the key engages the plurality of locking elements responsive to the key being inserted into the outer housing member.

22. A key comprising:

a gripping portion;

an actuating portion, the actuating portion comprising a plurality of pushing regions that extends radially away from a central axis and each pushing region of the plurality of pushing regions axially urges a locking element of a plurality of locking elements a predetermined distance toward a distal end of an inner core of a locking device; and wherein the key cooperatively engages the locking device, the locking device comprising:

the plurality of locking elements, each locking element of the plurality of locking elements comprising a projection;

an outer housing member comprising a key-receiving region and an internal face, the key-receiving region comprising a central opening and a plurality of apertures extending radially from the central opening;

the internal face comprising:

a plurality of axial channels channel; and an annular channel;

each axial channel of the plurality of axial channels and the annular channel being able to receive a respective projection of the plurality of locking elements;

each axial channel of the plurality of axial channels being aligned with a corresponding aperture of the plurality of apertures of the key receiving region;

an inner core, the inner core being receivable within the outer housing member and comprising a receiving portion for each locking element of the plurality of locking elements; and wherein each projection extends radially outwards from the inner core.

23. The key of claim 22, wherein the key comprises a guide portion.

24. The key of claim 22, wherein the plurality of pushing regions are equally spaced around the actuating portion.

25. The key of claim 22, wherein the plurality of pushing regions are not all equally spaced around the actuating portion.

26. The key of claim 22, wherein:

said actuating portion is star shaped;

the plurality of pushing regions extend radially from the actuating portion.

27. The key of claim 22, comprising an anti-drill deflector receiving portion.

28. The key of claim 22, wherein said actuating portion comprises the plurality of pushing regions, the plurality of pushing regions being movably connected to, and fixable to, the gripping portion, wherein said plurality of pushing regions push against the locking element.

29. The key of claim 28, wherein the plurality of pushing regions extend radially from the actuating portion.

30. A method of using a locking device and a key, the method comprising:

engaging the key with the locking device, the locking device comprising:

a plurality of locking elements, each locking element of the plurality of locking elements comprising a projection;

an outer housing member comprising a key-receiving region and an internal face, the key-receiving region comprising a central opening and a plurality of apertures extending radially from the central opening;

the internal face comprising:

a plurality of axial channels; and an annular channel;

each axial channel of the plurality of axial channels and the annular channel being able to receive a respective projection from the plurality of locking elements;

each axial channel of the plurality of axial channels being aligned with a corresponding aperture of the plurality of apertures of the key-receiving region;

an inner core receivable within the outer housing member and comprising a receiving portion for each locking element of the plurality of locking elements; and wherein each projection extends radially outwards from the inner core;

exerting, via an actuating portion of the key, pressure on the plurality of locking elements that urges the plurality of locking elements towards a distal end of the inner core;

responsive to the key reaching a predetermined position, aligning the projections with the annular channel formed in the internal face of the outer housing member; and rotating, via the key, the inner core.

* * * * *